US005695917A

United States Patent [19]

Nelson et al.

[11] Patent Number: 5,695,917

[45] Date of Patent: Dec. 9, 1997

[54] COMBINATION OF YELLOW FILTER DYE AND 4-EQUIVALENT PYRAZOLONE MAGENTA COUPLER

[75] Inventors: John Victor Nelson, Fairport; Margaret Jones Helber, Rochester; Mary Christine Brick, Webster, all of N.Y.

[73] Assignee: Eastman Kodak Company, Rochester, N.Y.

[21] Appl. No.: 561,677

[22] Filed: Nov. 22, 1995

[51] Int. Cl.[6] ..... G03C 1/06; G03C 1/815; G03C 1/825

[52] U.S. Cl. ..... 430/522; 430/510; 430/517; 430/554

[58] Field of Search ..... 430/522, 554, 430/517, 510, 543

[56] References Cited

U.S. PATENT DOCUMENTS

| | | | |
|---|---|---|---|
| 2,533,472 | 12/1950 | Keyes et al. | 430/522 |
| 2,538,008 | 1/1951 | Keyes et al. | 260/465 |
| 2,538,009 | 1/1951 | Keyes et al. | 95/8 |
| 3,627,532 | 12/1971 | Depoorter et al. | 430/522 |
| 4,420,555 | 12/1983 | Krueger et al. | 430/507 |
| 4,855,221 | 8/1989 | Factor et al. | 430/510 |
| 4,857,446 | 8/1989 | Diehl et al. | 430/510 |
| 4,861,700 | 8/1989 | Shuttleworth et al. | 430/517 |
| 4,900,653 | 2/1990 | Factor et al. | 430/522 |
| 4,923,788 | 5/1990 | Shuttleworth et al. | 430/507 |
| 4,940,654 | 7/1990 | Diehl et al. | 430/522 |
| 4,948,717 | 8/1990 | Diehl et al. | 430/510 |
| 4,948,718 | 8/1990 | Factor et al. | 430/522 |
| 4,950,586 | 8/1990 | Diehl et al. | 430/507 |
| 5,213,956 | 5/1993 | Diehl et al. | 430/522 |
| 5,213,957 | 5/1993 | Adachi | 430/522 |
| 5,256,528 | 10/1993 | Merkel et al. | 430/555 |
| 5,283,165 | 2/1994 | Diehl et al. | 430/522 |
| 5,288,600 | 2/1994 | Yamanouchi et al. | 430/522 |
| 5,296,344 | 3/1994 | Jimbo et al. | 430/522 |
| 5,342,743 | 8/1994 | Goto et al. | 430/522 |
| 5,449,594 | 9/1995 | Ueda et al. | 430/522 |

FOREIGN PATENT DOCUMENTS

| | | | |
|---|---|---|---|
| 0 434 026 A1 | 12/1990 | European Pat. Off. . | |
| 0 430 186 | 6/1991 | European Pat. Off. | G03C 1/83 |
| 0 524 598 A1 | 1/1993 | European Pat. Off. . | |
| 0 529 737 A1 | 3/1993 | European Pat. Off. . | |
| 0 543 921 | 3/1995 | European Pat. Off. | G03C 7/30 |
| 04 136 935 A | 5/1992 | Japan . | |
| 06 289 538 A | 10/1994 | Japan . | |
| 07 128 792 A | 5/1995 | Japan . | |
| 542 905 | 2/1942 | United Kingdom . | |
| 695873 | 8/1953 | United Kingdom . | |
| 760739 | 11/1956 | United Kingdom . | |
| WO 95 19169 A | 7/1995 | WIPO . | |

*Primary Examiner*—Geraldine Letscher
*Attorney, Agent, or Firm*—Edith A. Rice

[57] ABSTRACT

A photographic element contains a four-equivalent pyrazolone magenta coupler and a yellow filter dye represented by Formula I.

(I)

wherein:

A is an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$ each independently represents a substituted or unsubstituted methine group;

n is 0 or 1;

$R^{1-2}$ each independently represents hydrogen or an alkyl, aryl or acyl groups (including, for example, alkoxycarbonyl, amido and carboxyl);

Y represents non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group.

5 Claims, No Drawings

COMBINATION OF YELLOW FILTER DYE AND 4-EQUIVALENT PYRAZOLONE MAGENTA COUPLER

FIELD OF THE INVENTION

This invention relates to a photographic element comprising a yellow filter dye and a four-equivalent pyrazolone magenta coupler.

BACKGROUND OF THE INVENTION

Photographic materials often contain layers sensitized to different regions of the spectrum, such as red, blue, green, ultraviolet, infra-red, X-ray, to name a few. A typical color photographic element contains a layer sensitized to each of the three primary regions of the visible spectrum, i.e., blue, green and red. All silver halide emulsions used in these photographic elements have an intrinsic sensitivity to exposure by blue light (light of a wavelength between 400 and 500 nm). Increased sensitivity to blue light, along with sensitivity to green light or red light, is imparted through the use of various sensitizing dyes adsorbed to the silver halide grains. Exposure of green or red-sensitive emulsions by blue light results in a significant degradation of the photographic element's ability to accurately reproduce the colors of the original scene. As a result, the control of blue light exposure within a silver halide photographic element is a critical issue to the performance of these elements. Therefore, a material that absorbs blue light is usually coated between the blue sensitive layers and the remaining light sensitive layers of the element to prevent blue light from exposing the non-blue sensitive layers.

One commonly used blue light absorbing material is colloidal, or Carey-Lea, silver (J. Kapecki and J. Rodgers, "Color Photography" in *Kirk-Othmer Encyclopedia of Chemical Technology—Fourth Edition*, Volume 6, pp 965–1002, John Wiley and Sons, Inc., 1993). However, colloidal silver absorbs some green light and tends to increase the fog of silver halide emulsions in adjacent layers. The green light absorption results in a speed loss that is corrected through the use of larger grain size emulsions; however, this decreases image quality due to higher granularity. The increased fog requires coating higher emulsion laydowns or other corrective measures that have various costs associated with them.

Problem To Be Solved By The Invention

An alternative blue light absorbing material is a yellow filter dye such as those disclosed in U.S. Pat. Nos. 2,538,008, 2,538,009 and 4,420,555, and U.K. Patent Nos. 695,873 and 760,739. These dyes are often incorporated as microcrystalline dye dispersions. U.S. Pat. Nos. 4,950,586, 4,948,718, 4,948,717, 4,940,654, 4,923,788, 4,900,653, 4,861,700, 4,857,446, 4,855,221, 5,213,956 and 5,213,957 and EP 430,186 disclose the use of various dyes in solid particle dispersions. When properly designed, these dyes reduce or eliminate the green speed losses and increased fog caused by colloidal silver. However, we have discovered that when coated in a photographic element that also contains a four-equivalent pyrazolone magenta coupler, the existing yellow filter dyes may cause a yellow print-out problem. This problem results from a reaction of the yellow filter dye and the magenta coupler, either before or during the photographic processing of the element, to form an initially colorless intermediate. Thus, while the filter dye is completely decolorized by photographic processing, when the processed photographic element is exposed to light, such as display on a light table or illuminator, the intermediate reacts further to form a yellow stain. Formation of the yellow stain results in images with an objectionable yellow cast. It is therefore desirable to provide a yellow filter dye that prevents the formation of this yellow print-out while maintaining the existing advantages of this type of dye. It is towards this end that the present invention is directed.

SUMMARY OF THE INVENTION

The yellow print-out in a photographic element containing a yellow filter dye and a four-equivalent pyrazolone magenta coupler can be prevented by using certain yellow filter dyes. One aspect of this invention comprises a photographic element comprising a four-equivalent pyrazolone magenta coupler and a yellow filter dye represented by Formula I.

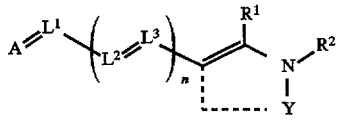

(I)

wherein:

A is an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$ each independently represents a substituted or unsubstituted methine group;

n is 0 or 1;

$R^{1-2}$ each independently represents hydrogen or an alkyl, aryl or acyl groups (including, for example, alkoxycarbonyl, amido and carboxyl);

Y represents non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group.

ADVANTAGEOUS EFFECT OF THE INVENTION

The problem of yellow print-out when yellow filter dyes are combined with four-equivalent pyrazolone magenta couplers has not been addressed in the prior art. The present invention identifies and offers a solution for this problem.

DETAILED DESCRIPTION OF THE INVENTION

Four-equivalent pyrazolone magenta couplers are commonly used in photographic elements. Preferred couplers are represented by Formula II

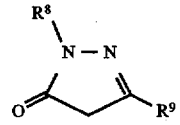

(II)

wherein:

$R^8$ is a substituted or unsubstituted aryl group;

$R^9$ is an anilino, carbonamido, ureido, carbamoyl, alkoxy, aryloxycarbonyl, alkoxycarbonyl, or N-heterocyclic group; and wherein a ballasting group is incorporated into $R^8$ and/or $R^9$. A ballasting group is a substituent that prevents substantial migration of the coupler within the photographic element. Migration should be limited during both shelf keeping and processing. Preferably, the ballasting groups are large organic substituents containing at least 12, and more preferably at least 15, contiguous atoms and including substituted or unsubstituted alkyl, aryl or aralkyl groups.

Representative examples of these magenta couplers are shown below.

M-1:

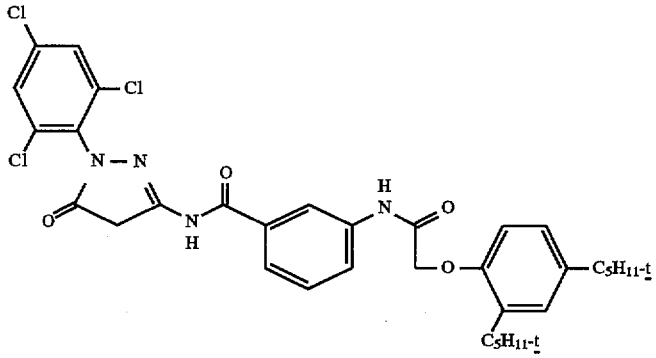

M-2:

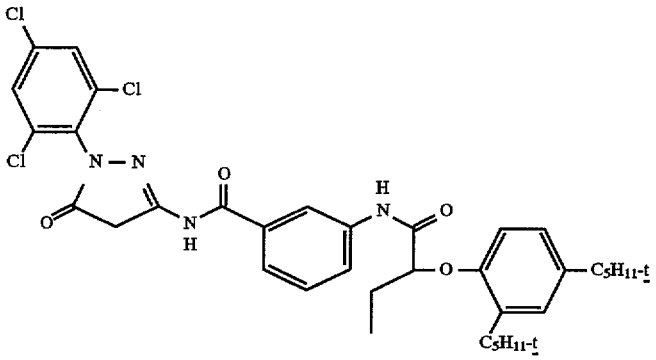

M-3:

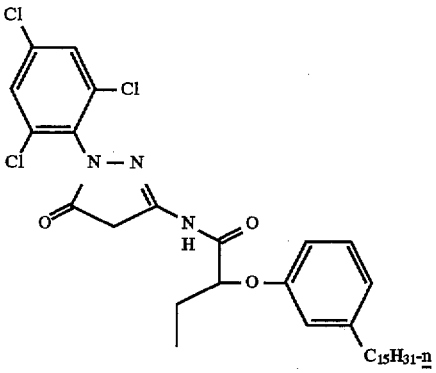

-continued

M-4:

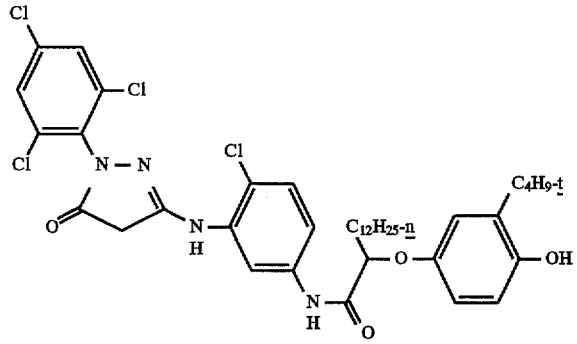

In addition to the non-polymeric couplers described above, the magenta coupler may also be a polymeric coupler if $R^8$ or $R^9$ is a divalent or a more polyvalent group that forms an oligomer, such as a dimer, or that connects the coupler skeleton to a polymeric main chain. The four-equivalent pyrazolone magenta couplers are normally coated in the green-light sensitive layers of the photographic element. However, they may be coated in other layers as well.

Yellow filter dyes are normally coated in an interlayer above the green-light sensitive layers where they are used to prevent blue-light exposure of the underlying green and red-light sensitive layers. However, they may be coated in other layers such as antihalation layers (for blue-light protection) or blue-sensitive layers (for speed control or increased acutance by reduction of light scatter). The yellow print-out problem begins when the dye, or fragments of the dye formed during storage or processing, react with the magenta coupler during processing. This reaction may take place in the layer where the magenta coupler is coated or in another layer, such as the layer where the yellow filter dye is coated. Reaction in layers other than the magenta coupler containing layer are possible because although the ballast group of the magenta coupler prevents substantial migration, under some circumstances magenta couplers may wander into other layers of the photographic element (European Patent Specification 0 543 921 B1). The intermediate formed from this reaction is colorless so that, immediately after processing, there is no undesired stain and it appears that the yellow filter dye has been completely decolorized and removed from the photographic element. However, if the photographic element is then exposed to light, such as illumination on a light box, the intermediate reacts further to form a yellow dye. This yellow dye is different in chemical structure than the original yellow filter dye. Its formation in the photographic element is highly undesirable as it results in an image with a yellow cast. This yellow cast is particularly noticeable in Dmin areas and light colored areas of the image.

The dyes of the present invention do not cause any yellow print-out when coated in a photographic element containing four-equivalent pyrazolone couplers. Formula I is described in detail as follows.

A in Formula I represents an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide. The acidic nucleus is preferably selected from the group consisting of benzoylacetonitrile, 2-phenyl-1,1,3-tricyanopropene, 5-pyrazolone, isooxazolone, barbituric acid, oxazolidindione, pyrazolidindione, indandione and pyrazolopyridone nuclei. The acidic nucleus may have a subsituent.

$L^1$, $L^2$ and $L^3$ in Formula I each independently represents substituted or unsubstituted methine groups. Preferable substitutents for $L^{1-3}$ are alkyl groups of between 1 and 6 carbons. Other useful substituents for $L^{1-3}$ include those listed below for $R^3$. In Formula I, n represents 0 or 1 with 0 being preferred.

Y in Formula I represents non-metal atoms which may be assembled to form a five membered heterocylic ring optionally comprising a fused substituted or unsubstituted benzene ring. Heterocyclic rings formed by Y are preferably selected from the group consisting of pyrrole, indole, pyrazole, pyrazolopyrimidone and benzindole. Dyes in which Y is an indole ring, a benzindole ring or a pyrrole are particularly preferred. $R^1$ and $R^2$ each independently represents hydrogen, alkyl, aryl or acyl groups (including, for example, alkoxycarbonyl, amido and carboxy).

The dye described by Formula I also comprises at least one ionizable group with a pKa value between 4–11 such as a carboxyl group, a sulfonamido group or a sulfamoyl group. Preferably, this group is a carboxy ($—CO_2H$) or sulfonamido group ($–NHSO_2R^{10}$, where $R^{10}$ is a substituted alkyl or aryl group as described for $R^3$ below).

The dyes of Formula I may be incorporated into the photographic element in any of the ways known in the art, but preferably as a dispersion of microcrystalline dye.

In a preferred/another embodiment, the objectives and advantages of the invention are met by photographic elements wherein the dye according to Formula I has Formula III:

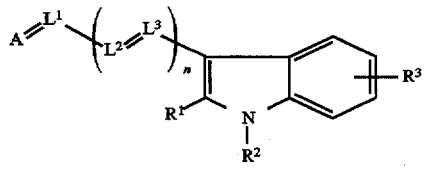

(III)

wherein:

A is an acidic nucleus selected from the group consisting of benzoylacetonitrile, 2-phenyl-1,1,3-tricyanopropene, 5-pyrazolone, isooxazolone, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzo[d]thiophene-1,1-dioxide and 3-dicynaomethine-2,3-dihydroxybenzo[d]thiophene-1,1-dioxide;

$L^{1-3}$ each independently represents a substituted or unsubstituted methine group;

n is 0 or 1;

$R^{1-2}$ each independently represents hydrogen or an alkyl, aryl or acyl groups (including, for example, alkoxycarbonyl, amido and carboxyl);

$R^3$=hydrogen or a substituent group; and wherein the dye comprises at least one ionizable group with a pKa value between 4–11 such as a carboxyl group, a sulfonamido group or a sulfamoyl group.

The groups A, $L^1$, $L^2$, $L^3$, $R^1$, and $R^2$ are described in greater detail above. The $R^3$ substituent group in Formula III can be substituted or unsubstituted alkyl, substituted or unsubstituted aryl or arlyoxy, or may be one of the following subsituents including, for example, hydrogen, halogen, cyano, amino, alkoxy, alkoxycarbonyl, amido, acyl, alkylamino, carboxy, sulfonamido, sulfamoyl or hydroxy. When $R^3$ is an alkyl or aryl group, it may be optionally substituted with one of the substituents listed above. The alkyl or aryl groups may be substituted with any of a number of substituents as is known in the art, other than those such as sulfo substituents, that would tend to increase the solubility of the dye so much as to cause it to become soluble at coating pH's. Examples of alkyl groups include methyl, ethyl, n-propyl, n-hexyl or isohexyl. Examples of substituted alkyl groups include, for example, methoxyethyl, hydroxymethyl, etc. Examples of alkoxy groups include, for example, methoxy, ethoxy, butoxy. Examples of aryl groups include phenyl, naphthyl, anthracenyl, pyridyl and styryl. Examples of substituted aryl groups include, for example, tolyl, m-cholrophenyl, p-methanesulfonylphenyl, etc.

In another preferred embodiment, the objectives and advantages of the invention are met by photographic elements wherein the dye according to Formula I has Formula IV:

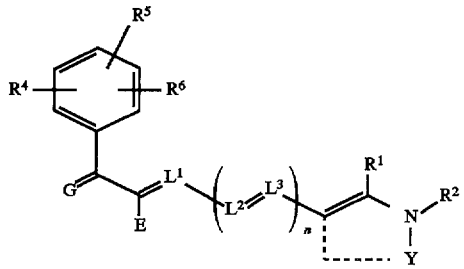

(IV)

wherein:

$R^{4-6}$ =each independently represents hydrogen or a substituent group;

G is O or dicyanovinyl (—$C(CN)_2$);

E is an electron withdrawing group;

$L^{1-3}$ each independently represents a substituted or unsubstituted methine group;

n is 0 or 1;

$R^{1-2}$ each independently represents hydrogen or an alkyl, aryl or acyl groups (including, for example, alkoxycarbonyl, amido and carboxyl);

Y represents non-metal atoms which form a five membered heterocyclic ring optionally comprising a fused substituted or unsubstituted benzene ring; and wherein the dye comprises at least one ionizable group with a pKa value between 4–11 such as a carboxyl group, a sulfonamido group or a sulfamoyl group.

The groups $L^1$, $L^2$, $L^3$, $R^1$, $R^2$ and Y are described in greater detail above. The substituent groups $R^4$, $R^5$ and $R^6$ can each independently be any of the groups described for $R^3$ above. The group E in Formula III is an electron withdrawing group. Electron withdrawing groups in organic compounds are well known in the art, such as described by March, Advanced Organic Chemistry, 3rd Ed., p. 238, the disclosure of which is incorporated herein by reference in its entirety. Examples of such groups include cyano, acyl, aminocarbonyl and alkoxycarbonyl. In a preferred embodiment, E is cyano.

In another preferred embodiment, the objectives and advantages of the invention are met by photographic elements wherein the dye according to Formula I has Formula V:

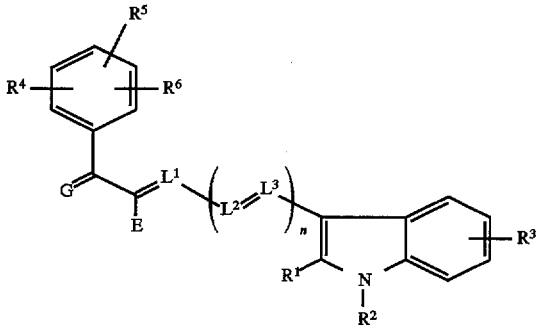

(V)

wherein:

$R^{4-6}$ each independently represents a hydrogen or a substituent group;

G is O or dicyanovinyl (—$C(CN)_2$);

E is an electron withdrawing group;

$L^{1-3}$ each independently represents a substituted or unsubstituted methine group;

n is 0 or 1;

$R^{1-2}$ each independently represents hydrogen or an alkyl, aryl or acyl groups (including, for example, alkoxycarbonyl, amido and carboxyl);

$R^3$ =hydrogen or a substituent group; and wherein the dye comprises at least one ionizable group with a pKa value between 4–11 such as a carboxyl group, a sulfonamido group or a sulfamoyl group.

The groups $R^4$, $R^5$, $R^6$, G, E, $L^1$, $L^2$, $L^3$, $R^1$, $R^2$ and $R^3$ are described in greater detail above.

Representative examples of the yellow filter dyes of the present invention are shown below.

YFD-1

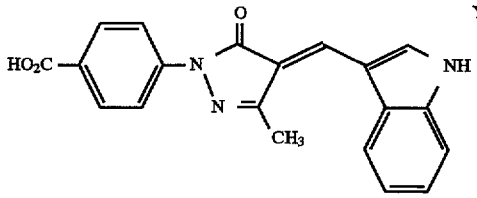

-continued

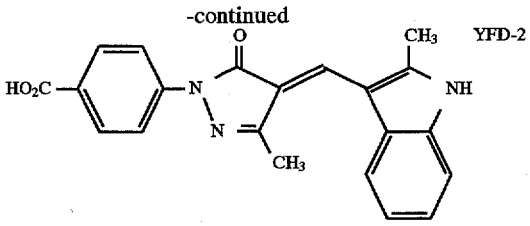

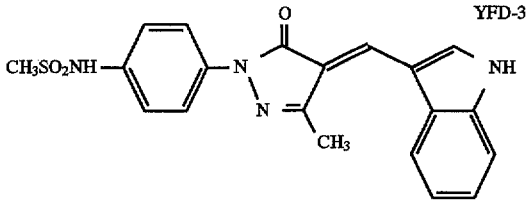

The yellow filter dyes of the present invention described in Table I refer to the generic structure shown below.

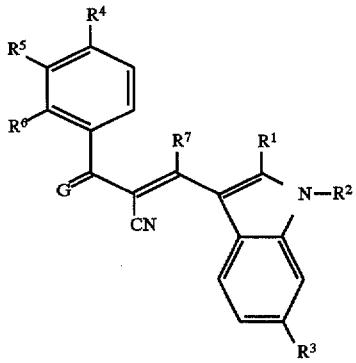

TABLE I

| YFD- | $R^4$ | $R^5$ | $R^6$ | $R^1$ | $R^2$ | $R^7$ | $R^3$ | G |
|---|---|---|---|---|---|---|---|---|
| 4 | $NHSO_2CH_3$ | H | H | H | H | H | H | O |
| 5 | COOH | H | H | H | H | H | H | O |
| 6 | $NHSO_2CH_3$ | H | H | H | H | H | H | $C(CN)_2$ |
| 7 | $NHSO_2C_3H_7$ | H | H | H | H | H | H | O |
| 8 | $NHSO_2CH_3$ | H | H | $CH_3$ | H | H | W | O |
| 9 | $NHSO_2C_2H_5$ | H | H | $CH_3$ | H | H | H | O |
| 10 | $NHSO_2C_3H_7$ | H | H | $CH_3$ | H | H | H | O |
| 11 | $NHSO_2C_4H_9$ | H | H | $CH_3$ | H | H | H | O |
| 12 | $NHSO_2C_4H_9$ | H | H | H | H | H | $CO_2CH_3$ | O |
| 13 | $NHSO_2CH_3$ | H | H | H | $CH_3$ | H | H | O |
| 14 | $NHSO_2CH_3$ | H | H | $CH_3$ | H | H | H | C(CN)2 |
| 15 | $NHSO_2CH_3$ | H | H | H | H | H | $CO_2CH_3$ | O |
| 16 | COOH | H | H | H | H | H | H | C(CN)2 |
| 17 | H | H | H | H | H | H | H | O |
| 18 | H | $NHSO_2CH_3$ | H | $CH_3$ | H | H | H | O |
| 19 | $NHSO_2CH_3$ | H | H | $CH_3$ | $CH_3$ | H | H | O |
| 20 | H | $NHSO_2CH_3$ | H | H | H | H | H | O |
| 21 | $CO_2CH_3$ | H | H | H | H | H | H | O |
| 22 | H | COOH | H | H | H | H | H | |
| 23 | H | COOH | H | $CH_3$ | $CH_3$ | H | H | O |
| 24 | COOH | H | H | H | H | $CH_3$ | H | O |
| 25 | COOH | H | H | H | H | H | COOH | O |
| 26 | $NHSO_2CH_3$ | H | H | H | H | H | COOH | O |
| 27 | OH | H | H | H | H | H | H | O |
| 28 | OH | OH | H | $CH_3$ | $CH_3$ | H | H | O |
| 29 | $SO_2NHCH_3$ | H | H | H | H | H | $CO_2CH_3$ | O |
| 30 | OH | H | OH | H | H | H | H | O |

The filter dyes of this invention can be incorporated into the photographic element in any of the ways known in the art. They may be added directly to, or dispersed in film forming polymeric vehicles and/or binders, as is well known in the art. These include both naturally occurring and synthetic binders, such as gelatin and gelatin derivatives, polyvinyl alcohols, acrylamide polymers, polyvinyl acetates, polyacrylates and the like. In certain instances, especially where the dye is mobile (e.g., a dye with one or more $SO_3$—constituents) it may be advantageous to use the dye in combination with a mordant, such as polyvinylimidazole and polyvinylpyridine, to aid in immobilizing the dye. The technology of mordanting dyes is well known in the art, and is described in further detail in Jones et al U.S. Pat. No. 3,282,699 and Heseltine et al U.S. Pat. No. 3,255,693 and 3,483,779. An oil-in-water dispersion of the dye may be prepared by dissolving the dye in an organic liquid, forming a premix with an aqueous phase containing dispersing aids such as water-soluble surfactants, polymers and film forming binders such as gelatin, and passing the premix through a mill until the desired particle size is obtained. The mill can be any high energy device such as a colloid mill, high pressure homogenizer, ultrasonic device, or the like. Preparation of conventional oil-in-water dispersions are well known in the art and are described in further detail in Jelly and Vittum U.S. Pat. No. 2,322,027. The dyes can also be loaded into a latex polymer, either during or after polymerization, and the latex can be dispersed in a binder. Additional disclosure in loaded latexes can be found in Milliken U.S. Pat. No. 3,418,127.

In a preferred embodiment, the dye is dispersed in the binder in the form of a solid particle dispersion. Such dispersions are formed by either milling the dye in solid form until the desired particle size range is reached, or by precipitating the dye directly in the form of a solid particle dispersion. In the case of solid particle milling dispersal methods, a coarse aqueous premix, containing the filter dye and water, and optionally, any desired combination of water soluble surfactants and polymers, is made, and added to this premix prior to the milling operation. The resulting mixture is then loaded into a mill. The mill can be, for example, a ball mill, media mill, jet mill, attritor mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media may be used if desired. The solid dye particles in the slurry are subjected to repeated collisions with the milling media, resulting in crystal fracture and consequent particle size reduction. The solid particle dispersions of the dye should have an average particle size of 0.01 to about 10 microns, preferably 0.05 to about 5 microns, and more prefereable about 0.05 to about 3 microns. Most preferably, the solid particles are of sub-micron average size. In the case of pH precipitation techniques, an aqueous solution of the dye is made at relatively high pH then the pH is lowered to cause precipitation of the dye. The aqueous dispersion can further contain appropriate surfactants and polymers previously disclosed for use in making pH precipitated dispersions. For solvent precipitation, a solution of the dye is made in some water miscible, organic solvent. The solution of the dye is added to an aqueous solution containing appropriate surfactants and polymers to cause precipitation as previously disclosed for use in making solvent precipitated dispersions.

Surfactants and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,924,916, 4,294,917, 4,940,654, 4,950,586, 4,927,744, 5,279,931, 5,158,863, 5,135,844, 5,091,296, 5,089,380, 5,103,640, 4,990,431,4,970,139, 5,256,527, 5,015,564, 5,008,179, 4,957,857, and 2,870,012, British Patent specifications Nos. 1,570,362 and 1,131,179 referenced above, the disclosures of with are hereby incorporated by reference, in the dispersing process of the filter dyes.

Additional surfactants or other water soluble polymers may be added after formation of the filter dye dispersion, before or after subsequent addition of the small particle dispersion to an aqueous coating medium for coating onto a photographic element support. The aqueous medium preferably contains other compounds such as stabilizers and dispersants, for example, additional anionic nonionic, zwitterionic, or cationic surfactants, and water soluble binders such as gelatin as is well known in the photographic element art. The aqueous coating medium may further contain other dispersion or emulsions of compounds useful in photography.

The photographic element of this invention is typically a multicolor element. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12*a* North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pa. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12*a* North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be either polydispersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process*, 4th Edition, Macmillan, N.Y., 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino- 3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The practice of the invention is described in detail below with reference to specific illustrative examples, but the invention is not to be construed as being limited thereto. In the examples the filter dye dispersions were prepared by the following procedures.

All filter dyes except FD-2 were dispersed by the following procedure:

A slurry containing 2.4 g dye, 1.92 g of a 10% aqueous solution of Luviskol K-30 polyvinylpyrrolidone (BASF), 2.15 g of a 6.7% aqueous solution of TX200 octylphenoxy ethylene oxide sulfonate (Union Carbide) and 17.53 g of distilled water was added to a 120 ml glass jar with 60 ml of 1.8 mm zirconium oxide ceramic beads. The jar was placed on a SWECO vibratory mill for 6 days. After milling, the final slurry particle size was less than 1 micron, and the slurry was diluted to a concentration of 5% dye with distilled water.

Filter dye FD-2 was dispersed by the following procedure:

A solid particle dispersion was prepared by circulating a slurry containing 36% dye, 3.6% TX200 octylphenoxy ethylene oxide sulfonate (Union Carbide) and 61.4% distilled water through a Netzsch 60 L media mill containing 54 L of 0.4 SEPR zirconium silicate ceramic beads until the final dispersion particle size was less than 1 micron. After milling, the slurry was diluted to a concentration of 5% dye and 7% gelatin with distilled water and deionized gelatin.

EXAMPLE 1

On a cellulose triacetate film support provided With a subbing layer was coated each layer having the composition set forth below to prepare a test format which was designated sample 101. The test format consists of a layer incorporating a four-equivalent equivalent pyrazolone magenta coupler and a separate layer incorporating a yellow filter dye. The test format will therefore provide a model of the light induced yellowing problem observed in photographic elements containing both yellow filter dyes and four-equivalent pyrazolone magenta couplers. In the composition of the layers, the coating amounts are shown as g/m$^2$.

| | |
|---|---|
| First Layer: Magenta Coupler Layer | |
| Magenta Coupier M-1 | 1.24 |
| Dispersed in Solvent S-2 | 0.62 |
| Gelatin | 1.88 |
| Second Layer: Yellow Filter Dye Layer | |
| Gelatin | 0.61 |
| Third Layer: Overcoat Layer | |
| Gelatin | 2.15 |
| Hardener H-1 | 0.08 |

Samples 102 to 111 were prepared in the same manner as described above for Sample 101 except for the addition of 0.22 g/m$^2$ of the yellow filter dye listed in Table I to the Second Layer. Sample 112 was prepared in the same manner as described above for Sample 102 except that magenta coupler M-1 was omitted from the First Layer.

Each of the samples thus prepared was cut into a 35 mm width strip. The samples were processed using standard Kodak E-6 processing solutions and methods. The Status A blue density was then measured for each sample. The samples were placed on a light box for 24 hours. The Status A blue density was then re-measured for each sample. The density values before and after the light box treatment, and the delta density, are tabulated in Table II.

TABLE II

| Sample | Yellow Filter Dye | Starting Density | Ending Density | Deita Density |
|---|---|---|---|---|
| 101 | None (Check) | 0.08 | 0.08 | 0 |
| 102 | FD-2 (Comparison) | 0.08 | 0.13 | 0.05 |
| 103 | FD-3 (Comparison) | 0.09 | 0.13 | 0.04 |
| 104 | FD-4 (Comparison) | 0.09 | 0.11 | 0.02 |
| 105 | YFD-1 (Invention) | 0.08 | 0.08 | 0 |
| 106 | YFD-2 (Invention) | 0.08 | 0.08 | 0 |
| 107 | YFD-3 (Invention) | 0.08 | 0.08 | 0 |
| 108 | YFD-4 (Invention) | 0.08 | 0.08 | 0 |
| 109 | YFD-5 (Invention) | 0.08 | 0.08 | 0 |
| 110 | YFD-6 (Invention) | 0.08 | 0.08 | 0 |
| 111 | YFD-7 (Invention) | 0.10 | 0.10 | 0 |
| 112 | YFD-2 without M-1 (Check) | 0.07 | 0.07 | 0 |

The check samples 101 and 112 demonstrate that unless both a comparison yellow filter dye and the magenta coupler are present there is no increase in blue density after light box treatment. From the results shown in Table II it is clear that the samples using the yellow filter dyes of the present invention exhibit no increase in blue density after the light box treatment. The comparison yellow filter dyes, which fall outside the scope of the present invention, exhibit an increased blue density.

EXAMPLE 2

On a cellulose triacetate support provided with a subbing layer was coated each layer having the composition set forth below to prepare a multilayer color photographic light-sensitive material which was designated sample 201. In the composition of the layers, the coating amounts are shown as g/m$^2$.

| | |
|---|---|
| First Layer: Antihalation Layer | |
| Black Colloidal Silver | 0.43 (as silver) |
| UV Dye UV-1 | 0.04 |
| Dispersed in Solvent S-1 | 0.04 |
| Gelatin | 2.44 |
| Second Layer: Intermediate Layer | |
| Gelatin | 1.22 |
| Third Layer: Slow Red Sensitive Layer | |
| Silver Iodobromide Emuision<br>tabular emuision (13:1 aspect ratio)<br>3% bulk iodide<br>spectrally sensitized with dyes SD-1 and SD-2 | 0.25 (as silver) |
| Silver Iodobromide Emulsion<br>tabular emulsion (6:1 aspect ratio)<br>4% bulk iodide<br>spectrally sensitized with dyes SD-1 and SD-2 | 0.20 (as silver) |
| Silver Iodobromide Emulsion<br>0.15μ equivalent spherical diameter<br>4.8% bulk iodide<br>spectrally sensitized | 0.12 (as silver) |
| Fine Grain Silver Bromide<br>0.07μ equivalent spherical diameter | 0.05 |
| Cyan Coupler C-1 | 0.23 |
| Dispersed in Solvent S-3 | 0.11 |
| Oxidized Developer Scavenger SCV-1 | 0.03 |
| Dispersed in Solvent S-3 | 0.03 |
| Gelatin | 0.86 |
| Fourth Layer: Fast Red Sensitive Layer | |
| Silver Iodobromide Emulsion<br>tabular emulsion (12:1 aspect ratio) | 0.68 (as silver) |

-continued

| | |
|---|---|
| 1.5% bulk iodide | |
| spectrally sensitized with dyes SD-1 and SD-2 | |
| Silver Iodobromide Emulsion | 0.12 (as silver) |
| 0.15μ equivalent spherical diameter | |
| 4.8% bulk iodide | |
| spectrally sensitized | |
| Fine Grain Silver Bromide | 0.08 |
| 0.07μ equivalent spherical diameter | |
| Cyan Coupler C-1 | 1.36 |
| Dispersed in Solvent S-3 | 0.68 |
| Gelatin | 2.15 |
| Fifth Layer: Interlayer | |
| Oxidized Developer Scavenger SCV-1 | 0.11 |
| Dispersed in Solvent S-3 | 0.11 |
| Inhibitor I-1 | o.ooi |
| Gelatin | 0.61 |
| Sixth Layer: Interlayer | |
| Filter Dye FD-1 | 0.06 |
| Gelatin | 0.61 |
| Seventh Layer: Slow Green Sensitive Layer | |
| Silver Iodobromide Emulsion | 0.27 (as silver) |
| tabular emulsion (7:1 aspect ratio) | |
| 3% bulk iodide | |
| spectrally sensitized with dyes SD-3 and SD-4 | |
| Silver Iodobromide Emulsion | 0.22 (as silver) |
| tabular emulsion (6:1 aspect ratio) | |
| 4% bulk iodide | |
| spectrally sensitized with dyes SD-3 and SD-4 | |
| Silver Iodobromide Emulsion | 0.11 (as silver) |
| 0.15μ equivalent spherical diameter | |
| 4.8% bulk iodide | |
| spectrally sensitized | |
| Magenta Coupler M-1 | 0.05 |
| Magenta Coupler H-2 | 0.11 |
| Co-dispersed in Solvent S-2 | 0.08 |
| Gelatin | 0.86 |
| Eighth Layer: Fast Green Sensitive Layer | |
| Silver Iodobromide Emulsion | 0.62 (as silver) |
| tabular emulsion (11:1 aspect ratio) | |
| 2% bulk iodide | |
| spectrally sensitized with dyes SD-3 and SD-4 | |
| Silver Iodobromide Emulsion | 0.06 (as silver) |
| 0.15μ equivalent spherical diameter | |
| 4.8% bulk iodide | |
| spectrally sensitized | |
| Magenta Coupler M-1 | 0.34 |
| Magenta Coupler M-2 | 0.78 |
| Co-dispersed in Solvent S-2 | 0.56 |
| Gelatin | 1.94 |
| Ninth Layer: Interlayer | |
| Oxidized Developer Scavenger SCV-1 | 0.11 |
| Dispersed in Solvent S-4 | 0.03 |
| Gelatin | 0.61 |
| Tenth Layer: Slow Blue Sensitive Layer | |
| Silver Iodobromide Emulsion | 0.48 (as silver) |
| tabular emulsion (13:1 aspect ratio) | |
| 2% bulk iodide | |
| spectrally sensitized with dyes SD-5 and SD-6 | |
| Yellow Coupler YEL-1 | 0.48 |
| Dispersed in Solvent S-3 | 0.16 |
| Gelatin | 0.86 |
| Eleventh Layer: Fast Blue Sensitive Layer | |
| Silver Iodobromide Emulsion | 0.65 (as silver) |
| tabular emulsion (22:1 aspect ratio) | |
| 3% bulk iodide | |
| spectrally sensitized with dyes SD-7 and SD-8 | |
| Yellow Coupler YEL-1 | 1.66 |
| Dispersed in Solvent S-3 | 0.56 |

-continued

| | |
|---|---|
| Gelatin | 2.37 |
| Twelfth Layer: First Protective Layer | |
| UV Dye UV-2 | 0.38 |
| UV Dye UV-3 | 0.07 |
| UV Dye UV-1 | 0.13 |
| Dispersed in Latex L-1 | 0.65 |
| Oxidized Developer Scavenger SCV-1 | 0.06 |
| Dispersed in Solvent S-3 | 0.56 |
| Gelatin | 2.37 |
| Thirteenth Layer: Second Protective Layer | |
| Fine Grain Silver Bromide | 0.12 (as silver) |
| 0.07μ equivalent spherical diameter | |
| Matte | 0.02 |
| 3.3μ spherical diameter | |
| Hardener H-1 | 0.32 |
| Gelatin | 0.98 |

Samples 202, and 204–206 were prepared in the same manner as described above for Sample 201 except that 0.22 $g/m^2$ of the yellow filter dye listed in Table II was added to the Ninth Layer. Sample 203 was prepared in the same manner as described for sample 202 except that an extra interlayer consisting of 0.61 $g/m^2$ of gelatin was coated between the Eighth and Ninth Layers.

Each of the samples thus prepared was cut into a 35 mm width strip. The samples were exposed to a step exposure using white light. The samples were then processed using standard Kodak E-6 processing solutions and methods. The Status A blue density was measured for the Dmin step of each sample. The samples were placed on a light box for 24 hours. The Status A blue density was then re-measured for the Dmin step of each sample. The density values before and after the light box treatment, and the delta density, are tabulated in Table III.

TABLE III

| Sample | Yellow Filter Dye | Extra Interlayer | Starting Density | Ending Density | Delta Density |
|---|---|---|---|---|---|
| 201 | None (Check) | N | 0.14 | 0.14 | 0 |
| 262 | FD-2 (Companson) | N | 0.19 | 0.27 | 0.08 |
| 203 | FD-2 (Comparison) | Y | 0.18 | 0.24 | 0.06 |
| 204 | FD-3 (Comparison) | N | 0.18 | 0.23 | 0.05 |
| 205 | FD-4 (Comparison) | N | 0.20 | 0.23 | 0.03 |
| 206 | YFD-4 (Invention) | N | 0.18 | 0.18 | 0 |

Compared to Sample 201 the comparison Samples 202 and 204–205 exhibit an increased blue Dmin density after the light box treatment. Comparison sample 203 demonstrates that the addition of an extra interlayer to create a separation between the yellow filter dye and four-equivalent pyrazolone magenta coupler is an ineffective means to eliminate the yellow stain problem. Invention sample 206 demonstrates that the yellow filter dye of the present invention eliminates any yellow stain formation.

The components employed for the preparation of light-sensitive materials not already identified above are shown below.

SCV-1:
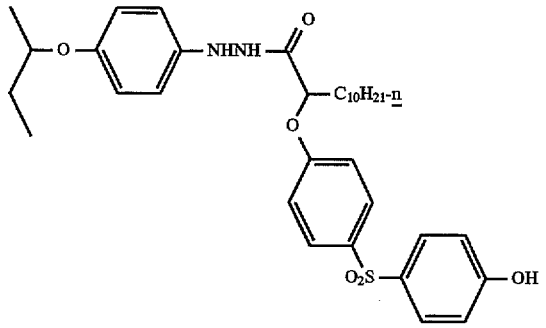
C-1:
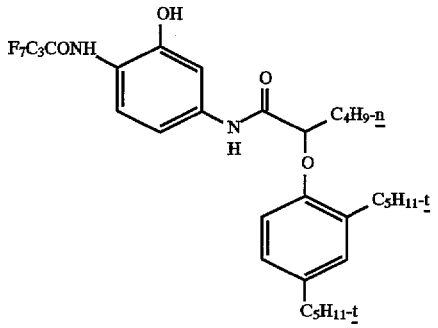
YEL-1:
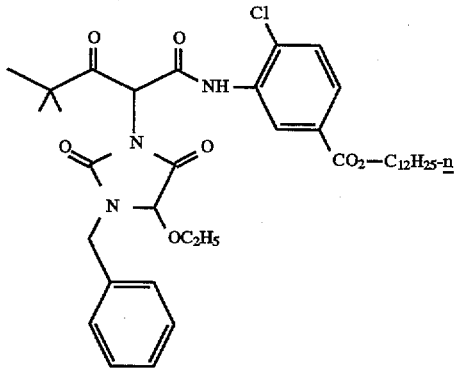
FD-1:
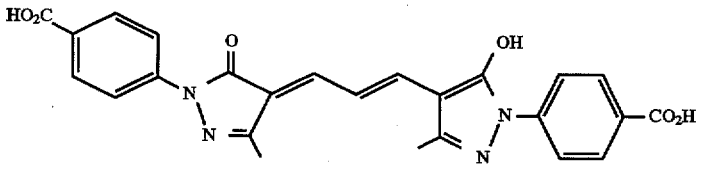
FD-2
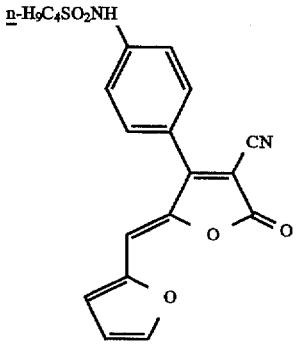

-continued
FD-3
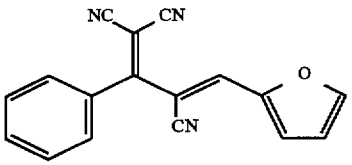
FD-4
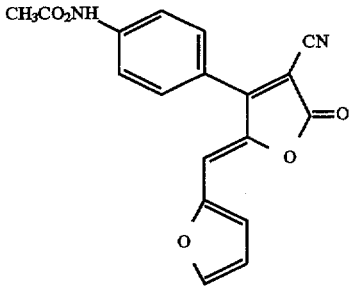
SD-1:
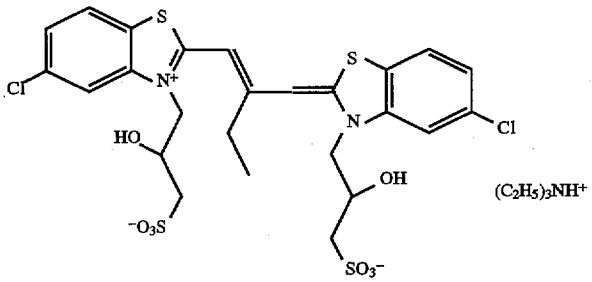
SD-2:
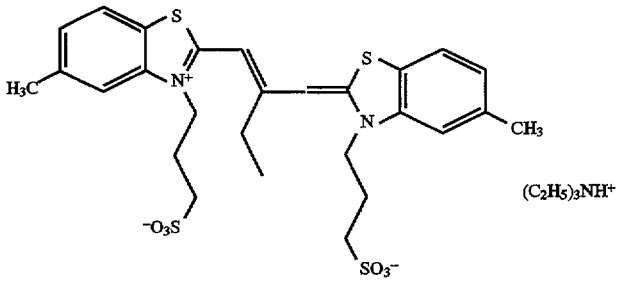
SD-3:
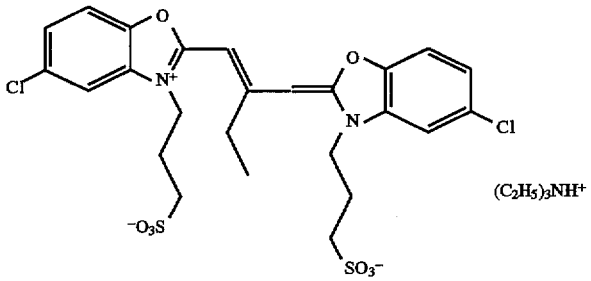
SD-4:
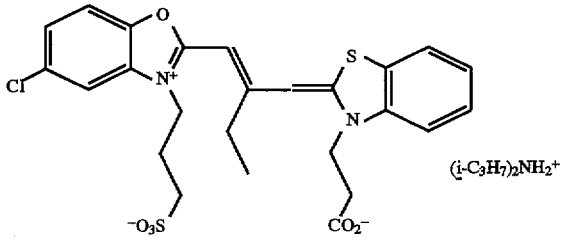

-continued
SD-5:
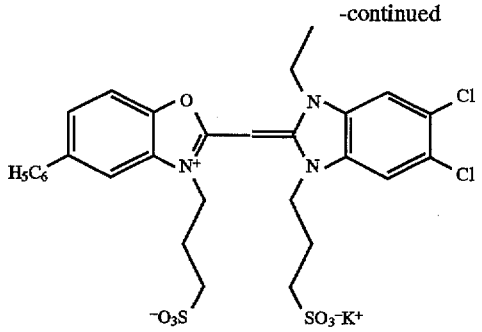
SD-6:
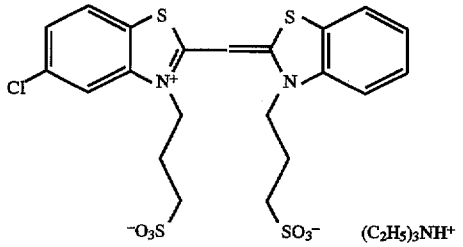
SD-7:
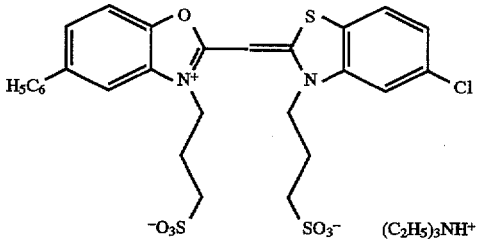
SD-8:
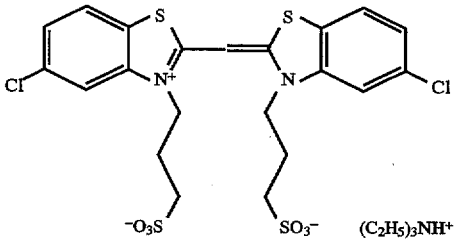
UV-1:
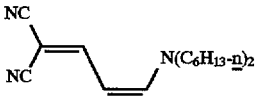
UV-2:
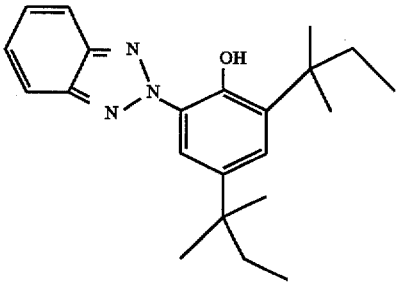
UV-3:
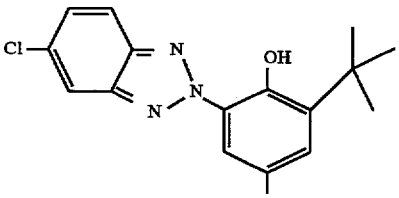

-continued

I-1:

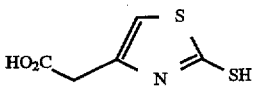

L-1:

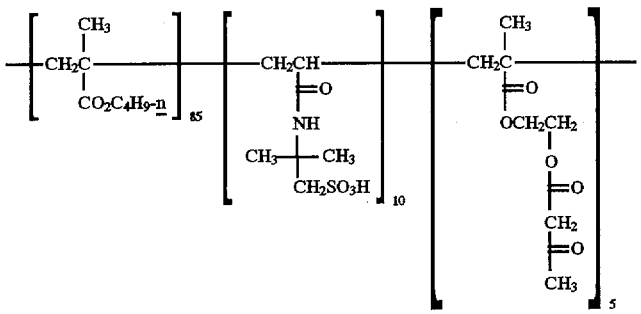

Hardener H-1 is 1,1'-[methylenebis(sulfonyl)]bisethene

Solvent S-1 is 1,4-Cyclohexylenedimethylene bis(2-ethylhexanoate)

Solvent S-2 is Phosphoric acid, tris(methylphenyl) ester

Solvent S-3 is 1,2-Benzenedicarboxylic acid, dibutyl ester

Solvent S-4 is N,N-Diethyl lauramide

The invention has been described in detail with particular reference to preferred embodiments, but it will be understood that variations and modifications can be effected within the spirit and scope of the invention.

What is claimed is:

1. A silver halide photographic element comprising at least one four-equivalent pyrazolone magenta coupler and a yellow filter dye of Formula I:

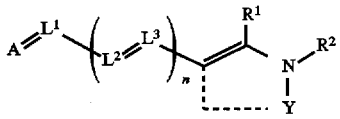

(I)

wherein:

A is an acidic nucleus selected from the group consisting of benzoylacetonitrile, 2-phenyl-1,1,3-tricyanopropene, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzothiophene-1,1-dioxide and 3-dicyanomethine-2,3-dihydroxybenzothiophene-1,1-dioxide;

$L^{1-3}$ each independently represents a substituted or unsubstituted methine group;

n=0 or 1;

$R^{1-2}$ each independently represents hydrogen or an alkyl, aryl or acyl groups;

Y represents non-metal atoms which form a five membered heterocyclic ring optionally comprising a fused substituted or unsubstituted benzene ring; and wherein the dye comprises at least one ionizable group with a pKa value between 4–11.

2. A photographic element according to claim 1, wherein the four equivalent magenta coupler is of the formula:

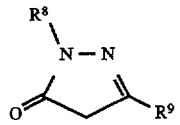

(2)

wherein:

$R^8$ is a substituted or unsubstituted aryl group;

$R^9$ is an anilino, carbonamido, ureido, carbamoyl, alkoxy, aryloxycarbonyl, alkoxycarbonyl, or N-heterocyclic group;

and wherein a ballasting group is incorporated into $R^8$ and/or $R^9$.

3. A photographic element according to claim 2, wherein the yellow filter dye of Formula I is of Formula III:

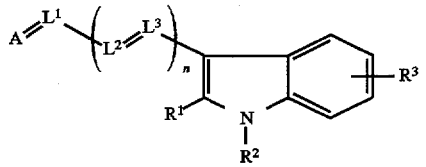

(III)

wherein:

A is an acidic nucleus selected from the group consisting of benzoylacetonitrile, 2-phenyl-1,1,3-tricyanopropene, barbituric acid, thiobarbituric acid, rhodanine, hydantoin, thiohydantoin, oxazolidindione, pyrazolidindione, indandione, pyrazolopyridone, 1,2,3,4-tetrahydroquinolin-2,4-dione, 3-oxo-2,3-dihydrobenzothiophene-1,1-dioxide and 3-dicyanomethine-2,3-dihydroxybenzothiophene-1,1-dioxide;

$L^{1-3}$ each independently represents a substituted or unsubstituted methine group;

n is 0 or 1;

$R^{1-2}$ each independently represents hydrogen or an alkyl, aryl or acyl groups;

$R^3$ is hydrogen or a substituent group; and wherein the dye comprises at least one ionizable group with a pKa value between 4–11 such as a carboxyl group, a sulfonamido group or a sulfamoyl group.

4. A photographic element according to claim 2, wherein the yellow filter dye of Formula I is of Formula IV:

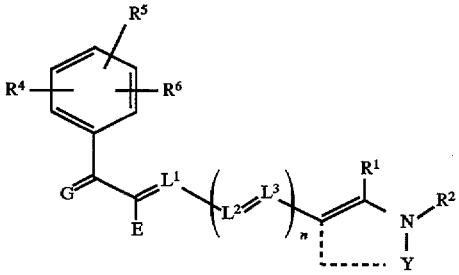

(IV)

wherein:

$R^{4-6}$ each independently represents hydrogen or a substituent group;

G is O or dicyanovinyl;

E is an electron withdrawing group;

$L^{1-3}$ each independently represents a substituted or unsubstituted methine group;

n is 0 or 1;

$R^{1-2}$ each independently represents hydrogen or an alkyl, aryl or acyl groups;

Y represents non-metal atoms which form a five membered heterocyclic ring optionally comprising a fused substituted or unsubstituted benzene ring; and wherein the dye comprises at least one ionizable group with a pKa value between 4–11.

5. A photographic element according to claim 2, wherein the yellow filter dye of Formula I is of Formula V:

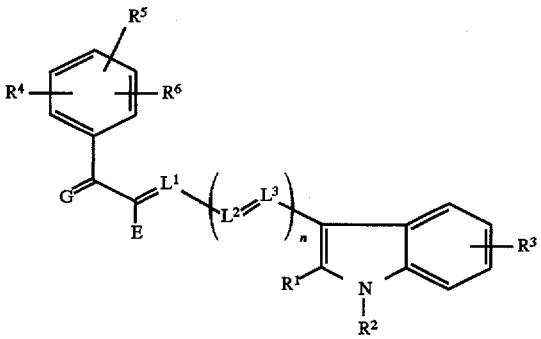

(V)

wherein:

$R^{4-6}$ each independently represents a hydrogen or a substituent group

G is 0 or dicyanovinyl;

E is an electron withdrawing group;

$L^{1-3}$ each independently represents a substituted or unsubstituted methine group;

n is 0 or 1;

$R^{1-2}$ each independently represents hydrogen or an alkyl, aryl or acyl groups;

$R^3$ =hydrogen or a substituent group; and wherein the dye comprises at least one ionizable group with a pKa value between 4–11 such as a carboxyl group, a sulfonamido group or a sulfamoyl group.

* * * * *